US009193183B2

(12) United States Patent
Woolfe et al.

(10) Patent No.: US 9,193,183 B2
(45) Date of Patent: Nov. 24, 2015

(54) LARGE-SCALE INKJET PRINTER

(71) Applicant: Inca Digital Printers Limited, Cambridge (GB)

(72) Inventors: Adam Woolfe, Cambridge (GB); Stephen George Tunnicliffe-Wilson, Cambridge (GB); William Ronald Stuart Baxter, Cambridge (GB)

(73) Assignee: Inca Digital Printers Limited (GB)

( * ) Notice: Subject to any disclaimer, the term of this patent is extended or adjusted under 35 U.S.C. 154(b) by 0 days.

(21) Appl. No.: 14/511,665

(22) Filed: Oct. 10, 2014

(65) Prior Publication Data

US 2015/0022604 A1 Jan. 22, 2015

Related U.S. Application Data

(63) Continuation of application No. 12/596,940, filed as application No. PCT/GB2008/001422 on Apr. 23, 2008.

(51) Int. Cl.

| | |
|---|---|
| ***B41J 2/165*** | (2006.01) |
| ***B41J 11/00*** | (2006.01) |
| ***B41J 2/515*** | (2006.01) |
| ***B41J 3/28*** | (2006.01) |
| ***B41J 25/00*** | (2006.01) |
| *B41M 3/00* | (2006.01) |
| *B41M 7/00* | (2006.01) |

(52) U.S. Cl.

CPC ..... *B41J 11/002* (2013.01); *B41J 2/515* (2013.01); *B41J 3/28* (2013.01); *B41J 11/001* (2013.01); *B41J 25/001* (2013.01); *B41M 3/008* (2013.01); *B41M 7/0072* (2013.01)

(58) Field of Classification Search

None

See application file for complete search history.

(56) References Cited

U.S. PATENT DOCUMENTS

| | | | |
|---|---|---|---|
| 4,169,167 | A | 9/1979 | McDowell |
| 5,057,854 | A | 10/1991 | Pond et al. |
| 5,216,442 | A | 6/1993 | Parks et al. |

(Continued)

FOREIGN PATENT DOCUMENTS

| | | | |
|---|---|---|---|
| DE | 4020129 | A1 | 1/1992 |
| EP | 0938976 | A1 | 9/1999 |

(Continued)

OTHER PUBLICATIONS

Certificate of Grant dated Jul. 11, 2012 for Application GB0920442.1.

(Continued)

*Primary Examiner* — Alejandro Valencia

(74) *Attorney, Agent, or Firm* — Lerner, David, Littenberg, Krumholz & Mentlik, LLP

(57) ABSTRACT

A multipass large format flat bed inkjet printer (1) for printing an image on a substrate is described. In examples described, the printer (1) has a print carriage (8) for supporting an array of printheads (18) adjacent the substrate (6) during printing; a bed (4) for supporting the substrate (6) during printing; and a movement mechanism (5) for providing relative movement of the print carriage (8) and the substrate (6) in a print direction during a print pass. The print carriage (8) is such that the width of the array of printheads (18) transverse to the print direction is at least substantially the full width of the image. in examples described, the printheads (18) provide an array of nozzles (22) which is substantially continuous across the array of printheads (18).

15 Claims, 13 Drawing Sheets

(56) References Cited

U.S. PATENT DOCUMENTS

| | | | | |
|---|---|---|---|---|
| 6,069,709 | A | 5/2000 | Harrington | |
| 6,089,693 | A | 7/2000 | Drake et al. | |
| 6,189,991 | B1 | 2/2001 | Wen et al. | |
| 6,234,605 | B1 | 5/2001 | Hilton | |
| 6,248,804 | B1 | 6/2001 | Lutz | |
| 6,270,184 | B1 | 8/2001 | Igarashi et al. | |
| 6,793,319 | B2 | 9/2004 | Ikemoto et al. | |
| 7,104,623 | B2 | 9/2006 | Samii | |
| 8,496,325 | B2 * | 7/2013 | Mitsuzawa | 347/102 |
| 2002/0080218 | A1 | 6/2002 | Kaga et al. | |
| 2003/0234851 | A1 | 12/2003 | Booth et al. | |
| 2004/0021732 | A1 | 2/2004 | Bergen | |
| 2005/0140763 | A1 | 6/2005 | Jackson | |
| 2005/0140765 | A1 | 6/2005 | Masumi et al. | |
| 2005/0179708 | A1 | 8/2005 | Ben-Zur | |
| 2005/0190225 | A1 | 9/2005 | Sakamoto | |
| 2005/0212835 | A1 | 9/2005 | Konno | |
| 2006/0050102 | A1 | 3/2006 | Kojima | |
| 2006/0071994 | A1 * | 4/2006 | Kojima | 347/101 |
| 2006/0092199 | A1 | 5/2006 | White et al. | |
| 2006/0092204 | A1 | 5/2006 | White et al. | |
| 2006/0114285 | A1 | 6/2006 | Silverbrook | |
| 2006/0230969 | A1 | 10/2006 | Vosahlo | |
| 2006/0268090 | A1 | 11/2006 | Choo et al. | |
| 2007/0024671 | A1 | 2/2007 | Silverbrook et al. | |
| 2007/0035569 | A1 | 2/2007 | Koto et al. | |
| 2007/0221082 | A1 | 9/2007 | Fukui et al. | |
| 2009/0244157 | A1 * | 10/2009 | Hishida et al. | 347/16 |

FOREIGN PATENT DOCUMENTS

| | | | |
|---|---|---|---|
| EP | 1238814 | A1 | 9/2002 |
| EP | 1382457 | A1 | 1/2004 |
| EP | 1415812 | A1 | 5/2004 |
| EP | 1870239 | A2 | 12/2007 |
| EP | 1872959 | A1 | 1/2008 |
| GB | 2343415 | A | 5/2000 |
| GB | 2461490 | B | 7/2012 |
| JP | 09-323434 | | 12/1997 |
| JP | 2001113797 | A | 4/2001 |
| JP | 2002254755 | A | 9/2002 |
| JP | 2003170607 | A | 6/2003 |
| JP | 2005238035 | A | 9/2005 |
| JP | 2006076067 | A | 3/2006 |
| JP | 2006248112 | A | 9/2006 |
| JP | 2007098879 | A | 4/2007 |
| WO | 9932301 | A1 | 7/1999 |
| WO | 2005039883 | A1 | 5/2005 |
| WO | 2006006598 | A1 | 1/2006 |
| WO | 2006116574 | A2 | 11/2006 |
| WO | 2006120158 | A1 | 11/2006 |

OTHER PUBLICATIONS

Decision of Grant dated Jun. 12, 2012 in Application GB0920442.1.
Examination Report dated Jun. 10, 2011 in Application GB0920442.1.
Examination Report dated Apr. 25, 2012 in Application GB0920442.1.
Examination Report dated Feb. 3, 2012 in Application GB0920442.1.
Examination Report dated Nov. 4, 2011 in Application GB0920442.1.
International Preliminary Report on Patentability for Application No. PCT/GB2008/001422 dated Nov. 5, 2009.
International Search Report and Written Opinion for Application No. PCT/GB2008/001422 dated Feb. 5, 2009.
Response filed Oct. 10, 2011 in UK Application 0920442.1.
Response filed Apr. 12, 2012 in UK Application No. 0920442.1.
Response filed Dec. 15, 2011 in UK Application 0920442.1.
Response filed May 15, 2012 in UK Application 0920442.1.
Japanese Office Action for Application No. 2010-504827 dated Jan. 22, 2013.
Third Party Observationsfor EP08737078.9 dated Aug. 12, 2013.

* cited by examiner

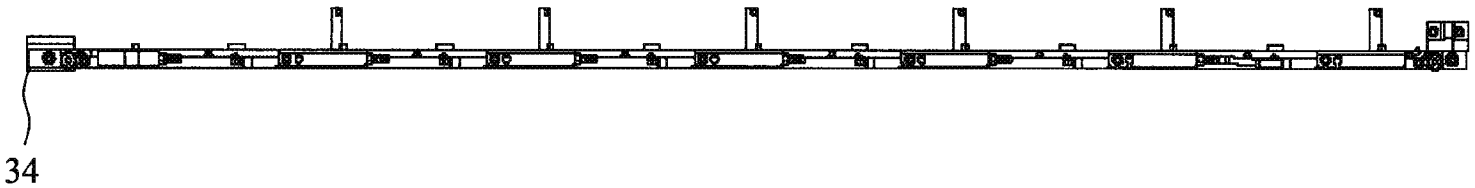
Fig. 10b
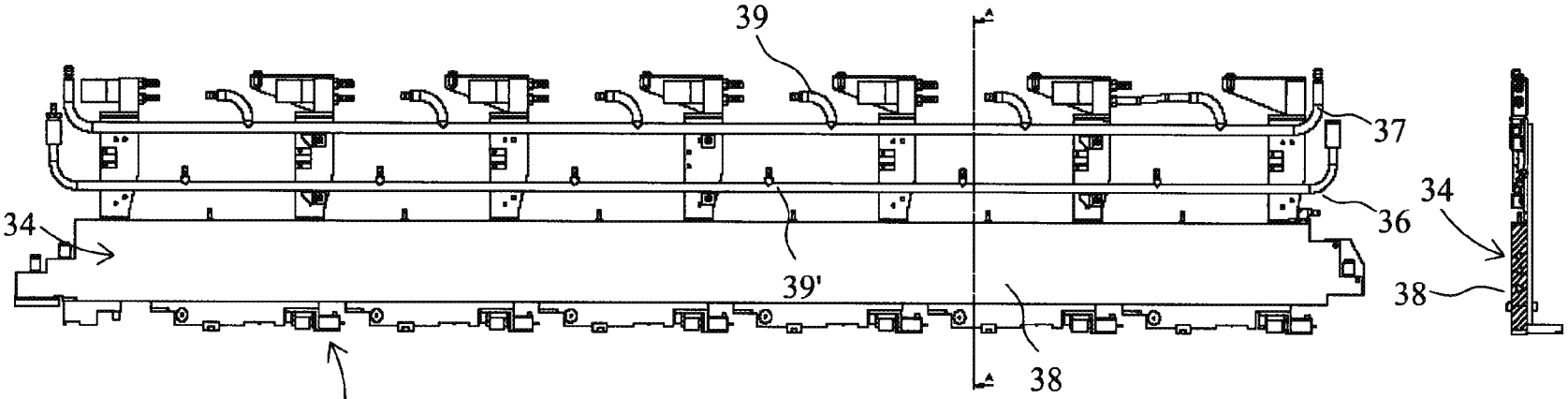
Fig. 10a
Fig. 10c

LARGE-SCALE INKJET PRINTER

The present application is a continuation application of U.S. patent application Ser. No. 12/596,940, filed Apr. 13, 2010, which is national phase entry under 35 U.S.C. §371 of International Application No. PCT/GB2008/001422 filed Apr. 23, 2008, published in English which claims priority from Great Britain Application No. GB 0707827.2, filed Apr. 23, 2007, all of which are hereby incorporated herein by reference.

This invention relates to inkjet printing. Aspects of the invention find particular application in the field of drop-on-demand inkjet printers, in particular piezoelectric ink jet printers. Particular aspects of the invention relate to large-scale inkjet printers. Printers are well-known devices for applying text and graphic images to a variety of substrates. A wide variety of different printers are available which are suitable for printing onto different types of substrate.

Large-scale industrial printers are adapted to print images onto larger substrates than, for example, office-base printers used for printing onto A4-size paper. Large-scale printers may be used for printing onto, for example, advertising boards, posters, and/or large batches of smaller substrates.

In an inkjet printing process, an array of droplets of, for example, ink is deposited onto the surface of a substrate in a pattern to form the required image. The droplets of ink are typically emitted from an array of nozzles of an inkjet printhead. A typical printer includes an array of several printheads arranged in a print carriage. There is relative movement between the print carriage and the substrate during the printing procedure for the whole of the required image to be printed onto the substrate.

This relative movement usually comprises the movement of the substrate as well as. in some cases, movement of the print carriage. This can lead to difficulties, in particular in controlling the movement of a large substrate.

In some printers, the substrate is supported on a cylindrical drum or roller which is rotated and about which the printheads are moved to achieve the required relative movement between the printheads and the substrate. Such a technique can decrease the footprint of the printer, but is not suitable for many printing operations, for example printing on flat and/or rigid substrates.

In a flat-bed printer, a flat substrate to be printed is supported, usually in a horizontal plane, while the printing medium (for example ink) is applied to the surface of the substrate. A variety of mechanisms for effecting relative movement between the printheads and the substrate are available. Where the substrate is moved, the movement may be provided by a reciprocating substrate table which supports the substrate during printing. In alternative arrangements, rollers and/or conveyor belts may be used to move the substrate. Alternatively, or in addition, the printhead arrangement may be moved during printing.

Flat bed printers are well known and are useful for printing onto a very large variety of substrates including rigid substrates, some of which could not successfully be printed using a drum printer.

Some printers print images in a single pass of the printheads relative to the substrate to be printed. In many printers, however, multi-pass printing is used in which the image is built up during several passes of the printheads relative to the substrate. The use of multiple passes can have the advantage that the effect of any misaligned or defective nozzles in the printhead may be reduced. In some arrangements, missing or deviated lets from the defective or misaligned nozzles may be "mapped out" and the droplets which would have been ejected by those nozzles may be provided instead by alternative nearby nozzles. Such methods can in some cases make multipass printers more tolerant of individual jet failures, for example those caused by defective or misaligned nozzles.

There are difficulties related to moving the substrate relative to the printheads, in particular for large printers where accurate movement of the substrate over long distances is required.

WO2006/120158 discusses various problems associated with large flat-bed printers and describes a large-scale flat bed printer and particular methods for supporting and moving a substrate table and print carriage which holds the printheads.

Furthermore, in known flat-bed printers, image quality issues can arise due to the way in which the image is built up in successive movements of the printheads relative to the substrate.

In many multipass flat-bed printers, an image is built up by laying down a series of print swathes in a plurality of print passes. During printing, the substrate reciprocates beneath the printheads in a plurality of print passes and the print carriage indexes between the passes so that the full image can be printed onto the substrate. This technique can result in visible artefacts in the image, where the swathes remain visible as texture and/or density artefacts, generally referred to as banding. Various techniques have been proposed to reduce the effect of banding. For example, the effects can be reduced in some situations by using smaller index distances, but in this way the number of print passes required is increased thus leading to inefficiencies. Some improvement may be obtained by improving drop placement accuracy and/or by using complex schemes of swathe construction (print modes), For example, a printing scheme can be used in which different printhead nozzles are used to print different parts of an image. in this way, it is possible to reduce artefacts arising from defects in particular nozzles in the printhead array. However, such methods can be complex and can also lead to a reduction in printing efficiency.

According to an aspect of the invention there is provided a multipass large format flat bed inkjet printer for printing an image on a substrate, the printer having a print carriage for supporting an array of printheads adjacent the substrate during printing; a bed for supporting the substrate during printing; a movement mechanism for providing relative movement of the print carriage and the substrate in a print direction during a print pass; wherein the print carriage is arranged such that the width of the array of printheads transverse to the print direction is at least substantially the full width of the image.

Preferably the width of the image extends in a direction generally transverse to the print direction.

In this way, the image can be built up in layers of print in the print passes, rather than in swathes as is known in the prior art Since the image is built in a series of layers rather than a series of swathes, improvements in print quality can be obtained.

Preferably the print carriage is such that the printhead array is wider than the image width.

Preferably substantially the full image width is printed in each print pass. By arranging for the printhead array to be wider than the image width, the printhead array can be indexed between passes without causing banding.

In some arrangements, the image width may be substantially the same as the width of the bed itself; in other arrangements, there may be a region at the edge of the bed which is not printable. Preferably the image width comprises the maximum width of image which can be printed onto a substrate on the substrate bed. In some printers a margin will be left so that the substrate can be wider than the image area. Reasons include ability to subsequently trim the substrate to the image edge, and to collect ink that overlaps on the bed rather than let it drift into the machine (although other methods are possible). Substrates are often supplied bigger than the nominal size to allow for trimming.

The substrate bed in preferred examples comprises a movable table, but may comprise any bed which supports the substrate in a substantially flat configuration during printing. For example, the bed may comprise one or more rollers for reciprocating the substrate past the printheads. Alternatively, the substrate may be held stationary, and the printheads reciprocated over it, for instance by supporting the printhead carriage on slideways. In some arrangements, both the substrate and the printheads may be moved.

Preferably the print carriage is such that an array of printheads can be mounted in the print carriage, the array being substantially continuous in the direction transverse to the print direction. Preferably the print carriage is adapted to support an array of printheads so that the array is substantially continuous in the direction of the width of the bed. Preferably the array of printheads is arranged so that there are no "gaps" in the printing in the transverse direction.

The printer may further include an array of printheads each including an array of nozzles, wherein the array of printheads is such that the array of nozzles is substantially continuous across the array of printheads.

It may be unnecessary for printing some images for the printheads to be indexed. Where multiple passes are required to build up the full image, it may be unnecessary to index the printheads in order to obtain the full image.

In many cases, however there will be indexing of the printheads, for example to reduce the effect of any faulty or misaligned nozzles, but in examples of the invention, the indexing need only be small, since large movement is not required for the printheads to print the full image width since the image is built up in layers rather than in print swathes. The indexing means that any given piece of the image has been built using a mixture of different nozzles and heads, hence reducing the density variations inherent to the nozzles.

Preferably the printer is adapted such that the printhead carriage is indexed a distance in the transverse direction less than 10%, preferably less than 5% of the width of the printhead array in the transverse direction.

Preferably the printer is adapted such that the printhead carriage is indexed in the transverse direction less than two printhead widths during the printing of the image. Where indexing of the printheads is carried out, preferably it is carried out only to increase the print density in the direction transverse to the print direction (for example where the pitch of the nozzles in the array of nozzles is greater than the required pitch of the image) and/or improve the print quality as discussed above. Preferably the indexing is not necessary to fill in "gaps" in the printed image caused by spaces between printheads mounted in the print carriage or to print swathes of print where the print carriage has a width substantially less than the image width required.

Preferably the print carriage is adapted to hold the printheads in an interleaved array.

As indicated above, it is preferable where an array of printheads is used for the nozzle array to be substantially continuous. For generally commercially available printheads the nozzles do not extend to the lateral edges of the printhead and so side-by-side mounting of the printheads would generally not give rise to a continuous array of nozzles. By providing an interleaved array of printheads, a substantially continuous array of nozzles can be achieved. For example, the array of printheads may comprise a plurality of rows of printheads, the printheads of each row being spaced apart and the rows being offset so that the nozzles of the printheads of the rows form a substantially continuous array of nozzles in the direction of the rows. Alternatively the printheads can be angled to allow a continuous array.

Aspects of the invention find particular application in relation to large format printers, in particular in relation to wide format printers.

For example, a standard format office printer may be adapted to print on substrates having a size up to A4. A large format commercial printer is adapted to print on substrates having a size greater than A3 or A0. Where reference is made to large format and/or wide format printers, preferably this refers (where appropriate) to printers adapted to print onto substrates having a width (preferably in a direction transverse to the printing direction) greater than 80 cm, preferably greater than 1 m, preferably greater than 1.2 m. Aspects of the invention find particular application in relation to printers for printing on substrates having a width over 1.5 m.

Preferably the width of the substrate bed transverse to the print direction is not less than 1.5 m.

A broad aspect of the invention provides a wide format multipass inkjet printer (preferably adapted for printing on substrates having a width greater than 1.5 m) having a print carriage including an array of printheads wider than the printable width of the substrate to be printed. Depending on the width of the substrate to be printed, the printer may have a print carriage wider than 80 cm, preferably wider than 1 m, preferably wider than 1.2 m, most preferably wider than 1.5 m.

Preferably the print carriage comprises a single structure having the preferred width.

Alternatively, the print carriage may be formed of a plurality of components where the overall width of the resulting array of printheads is greater than the preferred width.

By having the printheads extending across a substantial portion of the substrate and/or image, the need to move the printhead carriage transverse to the print direction can be reduced, or at least the distance of transverse movement can be reduced.

In examples of this aspect of the invention, banding can be reduced and in some cases be eliminated by printing the full image width on each pass. In this way, there is no tendency to build "lawn stripes". This aspect of the invention can also give rise to high productivity when compared with existing printers, since fewer print passes are required.

Preferably the printer is arranged to move the substrate past the print carriage to effect the printing. However, it is envisaged that the substrate might be substantially fixed while the print carriage is moved or that both the substrate and print carriage are moved to effect the print pass. References herein to movement of the substrate or print carriage should preferably be construed accordingly. In preferred examples however, it is the substrate which is moved to effect the printing pass.

While having a wide print carriage can give rise to significant increases in image quality and/or speed of printing, the large numbers of printheads and printing nozzles can give rise to further difficulties.

Printing the full width of an image with each pass of the substrate requires a large number of printheads. In examples described herein, 144 printheads are used for each colour, giving 576 printheads for a CMYK four-colour print arrangement; such a large printhead arrangement allows for a print width of more than 1.5 m Such a large number of printheads can make it difficult to replace an individual printhead, particularly if the printhead to be replaced is near the middle of the array, and significant difficulties are presented when aligning the printheads.

The print carriage may include means for mounting a plurality of printhead modules.

Preferably each module includes a plurality of printheads. Preferably the print carriage includes means for mounting a modular array of printheads.

This important feature may be provided independently. Thus an aspect of the invention provides a printer having a print carriage including means for mounting a plurality of printhead modules.

By providing a plurality of modules of printheads, the replacement of printheads can be facilitated and easier alignment of the printheads on site is possible. Preferably each module includes at least 10 printheads, preferably at least 20 printheads. In examples described herein, 24 printheads are contained in each module.

The module may form a field replaceable unit.

The modules may be nested. In some arrangements, it will be preferable for the printheads to be interleaved. As indicated above, the printheads may be arranged in offset rows. Preferably such an arrangement is also present in the printhead modules.

The printhead modules may therefore have an indented configuration. The modules may be nestable to effect the interleaving of the printheads.

Preferably the printer further includes a fibre optic link to and/or from the module.

Preferably substantially all data and control from and to the module is via a fibre optic link. Preferably the fibre optic link includes a single pair of fibre optic links. Preferably the data and/or control connections are daisy-chained, thus further simplifying connections. Preferably a single transmit/receive pair of fibre optics is used to control several (for example four) modules. The number of modules which can be daisy chained together will depend on the available bandwidth.

Such an arrangement can simplify routing connections.

The module is preferably largely self contained, so that few connections are needed between the printer and the module. Otherwise, in some arrangements, routing the connections might be impractical. Preferably the module includes a single connection (or pair of connections for input and output as appropriate) for each input to the module.

Preferably the printer includes a common rail for supplying a service, for example a consumable to a plurality of printheads, and a supply line attached to the common rail for connecting the common rail to supply the service to the printheads.

Preferably the common rail includes a plurality of supply lines each for supplying the service to a module.

Preferably each input to the printhead or printhead module is supplied from a common rail.

For example, ink, power and meniscus vacuum can be supplied on common rails, thus simplifying routing and connection of printheads and/or modules.

The correct alignment of the printheads may be an important factor with regard to the print quality achieved. Aligning a large number of individual printheads may be very time consuming. By using modules of printheads, the alignment of the printheads in the printer may be facilitated. In preferred arrangements, the printheads within each module are pre-aligned, for example by being set at the factory when the module is manufactured. Thus the alignment on site is preferably only the alignment of the modules themselves within the printer.

The printer may comprise a plurality of printer modules, the printer further including means for aligning a module in the printer.

Preferably the means for aligning the module comprises a mechanical device, for example a motor for moving the module, the printer further preferably including means for determining the position of the module.

This important feature finds independent application to a wide variety of printers; in particular to printers having a large number of printheads or printhead modules where manual alignment would be difficult.

Thus a further aspect of the invention provides an alignment system for a printer for use in the alignment of printheads in the printer, the system comprising a plurality of printhead moving devices for moving the printheads.

Preferably the printhead moving devices comprise remote controllable devices. In this way, controlled fine tuning of the position of the printheads or modules can be obtained and movement of printheads in inaccessible locations can be facilitated. Preferably the moving devices comprise mechanical, preferably electrical mechanical devices. The remote control of the printheads also can have important safety advantages compared with manual adjustment of the printhead positions. By moving the printheads by remote control, the printheads can be moved when its axes are live, but the axes can be non-live for, for example, manual locking of the printhead position when the correct alignment is obtained.

Preferably the system further comprises a device, for example a camera system, for determining the position of the printhead. Thus an operator may operate the printhead moving devices remote from the printhead array while monitoring the position of the printheads by viewing the output of one or more camera devices.

The printer preferably further includes a curing device, for example a radiation source, for example UV curing lamp in arrangements where UV curing ink is used.

The printer may further include a curing device for curing print material printed onto the substrate wherein the curing device extends across substantially the full width of the image transverse to the printing direction. In this way, the full width of the image may be cured without transverse movement of the curing device being required.

The print material may comprise ink. Where the print material is UV curable ink, preferably the curing device comprises a radiation source, for example a UV source.

For example the curing device may comprise a mercury lamp or array of light emitting diodes.

The device may comprise a single component or may include several elements.

In some preferred arrangements, the curing device extends substantially the full printable width of the substrate bed. Preferably the curing device is wider than the image width.

The printer may further include a curing device wherein the position of the curing device is substantially fixed during printing.

Preferably the curing device is not movable transverse to the print direction. Preferably the curing device is not movable, although some vertical movement may be possible, for example to allow for different thickness of substrates. In some arrangements, the vertical position of the device would be fixed before the printing operation is carried out, and the vertical position would not be moved during the printing operation itself.

This feature is of particular benefit where the curing device is large. Moving a large and heavy device can give rise to various difficulties.

Where the curing device extends across substantially the whole printable width of the substrate bed, then preferably no transverse movement of the device is necessary.

Preferably the curing device is connected to a fixed beam. Where the printheads are indexed during printing, preferably the curing device is not fixed to the printhead carriage. This can simplify mounting of the curing device and also help to reduce the load on the print carriage.

The substrate bed may comprise means for reducing reflection of radiation from the curing device.

The reflection reducing means may comprise reflection reducing formations. Such features can reduce the amount of radiation reflected to the printheads from the curing device. Such reflected radiation can be disadvantageous, for example where it effects curing of the print material at the nozzles of the printheads.

Many UV lamps are fitted with shutters which close to reduce the amount of radiation emitted. However, these shutters are often not fast-acting enough to reduce sufficiently the reflected light reaching the printheads.

Where the substrate bed includes a table, preferably the table includes reflection reducing louvers on the table, preferably at the end of the table. Where the printing of the substrate is bi-directional, preferably both ends of the table are provided with reflection reducing means.

Fitting lamps both sides of the carriage allows bidirectional printing, and also increases UV dose with unidirectional printing.

The printer may comprise a radiation source, wherein the printer is adapted to print an image in a plurality of passes, each pass comprising the steps of printing print material onto the substrate and emitting radiation towards print material on the substrate, wherein the printer includes a control device for controlling the radiation emitted such that a first dose of radiation is emitted towards the print material on a first pass and a second dose of radiation is emitted towards the print material on a subsequent pass.

By applying different power radiation to the print material, for example ink, emitted on different passes, different curing effects may be obtainable.

For example the gloss level of the ink may be changed by altering the power emitted by the radiation source on different passes.

This feature is of particular benefit where the print carriage extends across the full print width.

In a wide format printer where the image is built in layers rather than in swathes it is therefore possible to control gloss levels across the whole image by altering the power of the radiation applied. For instance, low UV power can be used for initial passes to prevent the formation of a low energy surface, and then higher power used for subsequent passes for example the last pass to fully cure the ink film. The print could be post cured off the machine.

Where the print carriage is indexed large distances during printing as in the prior art, careful control of the radiation sources is required. However, in some arrangements according to the present invention, the control of the radiation sources can be simplified where substantially the whole image width is printed in each pass.

The invention also provides a printer comprising a radiation source, wherein the printer is adapted to print an image on a substrate in a plurality of printing passes, each printing pass comprising the steps of printing print material onto the substrate and emitting radiation towards print material on the substrate, wherein the printer includes a control device operable such that a first dose of radiation is emitted towards the print material on a first printing pass and a second dose of radiation is emitted towards the print material on a subsequent curing pass.

Preferably the control device controls one or more of the power input to the radiation device, the relative speed of movement of the radiation source and the substrate and the configuration of the radiation source. For example, the configuration of the radiation source may include the positioning of one or more shutters associated with the radiation source. These features have general relevance to a wide range of printers and are discussed further below.

The print carriage may be translatable in a transverse direction, so as to be moved away from the substrate bed.

It has been found preferable for construction and maintenance that the print carriage can be moved fully clear of the substrate bed.

The printer may further include a cleaning device for cleaning a printhead, wherein the cleaning device is adapted to clean a plurality of printheads simultaneously. In some arrangements, the cleaning device is adapted to clean substantially all of the printheads in one pass of the cleaning device relative to the printheads.

This feature can give enhanced speed and efficiency of cleaning.

The printer may further comprise a gantry for supporting the print carriage, wherein the gantry is releasably attached to the substrate bed.

Where the printer is large, it may be convenient for it to be shipped as more than one module. Preferably the substrate bed and associated control and movement devices comprise a first module and the gantry and print carriage and associated devices comprise a second module. It is envisaged that in this way, efficiencies may be made where a particular substrate bed module can be teamed with more than one different print carriage module.

This feature is provided independently.

According to a further aspect of the invention there is provided a kit for a printer comprising a first module and second module, the first module comprising a substrate bed and associated control and movement devices and the second module comprising a print carriage, a gantry for supporting the print carriage wherein the first and second modules are releasably attachable to each other. The modules may be provided independently.

Aspects and features of the present invention find application in a wide range of printers.

A further aspect of the invention provides a multipass inkjet printer for printing an image on a substrate, the printer having a print carriage for supporting a plurality of printheads adjacent the substrate during printing; means for supporting the substrate during printing; a movement mechanism for providing relative movement of the print carriage and the substrate in a print direction during a print pass; wherein the print carriage is arranged such that the printheads extend across at least substantially the full printable width of the substrate, and/or where the width of the array of printheads transverse to the print direction is at least substantially the full width of the image.

A further aspect of the invention provides a multipass inkjet printer for printing an image on a substrate, the printer having a print carriage for supporting a plurality of printheads adjacent the substrate during printing; a bed for supporting the substrate during printing; a movement mechanism for providing relative movement of the print carriage and the bed in a print direction during a print pass; wherein the print carriage is arranged such that the printheads extend across substantially the full printable width of the substrate bed.

Preferably substantially the full image width can be printed in each pass.

A further aspect of the invention provides a multipass inkjet printer for printing an image on a substrate, the printer having a print carriage for supporting a plurality of printheads adjacent the substrate during printing; means for supporting the substrate during printing; a movement mechanism for providing relative movement of the print carriage and the substrate in a print direction during a print pass; wherein the arrangement is such that the distance of movement of the print carriage in the indexing direction during printing the image is less than 10%, preferably less than 5% of the width of the printhead array in the indexing direction.

Preferably the indexing direction is generally transverse to the print direction.

In particular examples described herein, features and aspects of the invention find application in relation to flat bed printers in which a table moves relative to a printhead arrangement. However, other arrangements are possible. For example, the bed for supporting the substrate to be printed might comprise a drum of a drum printer. The printer may comprise a reel-to-reel printer. The substrate may comprise a web of material. One or more of these features may be applied, as appropriate to any aspect of the invention described herein.

A broad aspect of the invention provides an inkjet printer adapted to print an image at least 1.5 m wide in a direction transverse to the print direction, wherein the printer is adapted to print the image in layers of print. Preferably the printer is adapted not to print the image in print swathes.

Features described in the present application find particular application in relation to large format printers. Such printers are preferably ones capable of printing images at least 1.5 m wide. In a large format printer, preferably each row or course of nozzles transverse to the printing direction includes at least 1000, preferably at least 2000, preferably at least 3000 nozzles. Preferably the printhead arrangement of a printer includes at least 10 000, preferably at least 15000, or at least 30000 printhead nozzles. In an example described below, the printhead arrangement includes more than 70000 nozzles.

Preferably the printer is an industrial printer, in that it is preferably suitable for printing onto substrates other than, for example, standard documents. Thus the printer is preferably not for printing on sheets of paper, and can thus be contrasted with a standard office printer.

In many cases, it will be preferable for the printer to be adapted to print onto rigid substrates. However, as indicated herein, aspects and features of the invention can be applied in relation to drum printers and/or printers in which the substrate is a web (for example fed in the printer using a reel-to-reel mechanism).

These features may be applied to any aspect or feature described herein.

In aspects of the present invention, preferably the ink comprises a curable ink, preferably radiation curable ink. UV curable ink is particularly appropriate in some examples.

Preferably the substrate and the ink are such that there is little absorption of the ink into the substrate. Preferably the substrate is such that there is substantially no absorption of the ink into the substrate.

Preferably the arrangement is such that a substantial proportion of the deposited ink remains on the substrate, preferably on the surface of the substrate. For example, preferably at least 50%, more preferably at least 60%, 70%, 80% or at least 90% of the ink remains on the substrate, preferably on the surface of the substrate. This is to be contrasted with solvent-based inks where only a small amount of the ink deposited remains on the substrate.

Preferably the ink has low volatility.

The ink may be a curable ink, preferably radiation curable ink. Heat curable ink may be used, or hot melt ink or a hybrid ink. For example the ink may be one which is heated in the printheads so that the ink has a suitable viscosity for printing. On contact with the cool substrate, the ink becomes solid and is subsequently cured.

The term ink should be interpreted broadly to include any appropriate printing material to be deposited on the substrate.

When printing, it is common for texture striping to be seen on prints where some bands of print look different from others. This is sometimes called "lawn stripes" as it is a similar effect to that obtained when mowing grass. Some bands of printing look dark from one angle and lighter from another. This is a particular problem when a printed image is laid up in stripes rather than in full image layers as described herein. The problem of lawn stripes is a particular problem for UV curable ink, because the droplets have a significant height as the UV ink has a tendency to remain on the substrate surface. This can be compared with solvent-based inks where the ink thickness is considerably less due to absorption into the substrate and the inclusion of volatile solvent in the ink. For solvent based ink, there is also a tendency for subsequent ink droplets to redissolve an ink film on a surface so that there is less tendency to obtain a series of stacked droplets on a substrate surface as is sometimes obtained for UV curable ink.

Printing on absorbent surfaces with oil or water-based ink can reduce the problem of lawn-stripes since most of the ink lies below the surface.

Hot melt inks can also show the problem of lawn striping.

Aspects of the present invention include features which can reduce the effect of lawn striping. Such aspects are particularly applicable therefore for use with UV curable ink and hot melt inks.

A further aspect of the invention comprises a method of printing an image in a plurality of passes using an inkjet printer, the printer having a print carriage for supporting an array of inkjet printheads adjacent the substrate during printing and a bed for supporting the substrate during printing, the method comprising: providing relative movement of the print carriage and the bed in a print direction during a print pass: wherein the print carriage is arranged such that the width of the array of printheads transverse to the print direction is at least substantially the full width of the image. The invention also provides a printer module comprising a plurality of printheads.

Also provided by the invention is a method of printing an image using curable print material in a plurality of printing passes, using a printer comprising a radiation source, the method comprising; printing print material onto the substrate in a first pass and emitting a first dose of radiation from the radiation source towards print material on the substrate, printing print material onto the substrate in a second pass and emitting a second dose of radiation from the radiation source towards print material on the substrate, wherein the first dose of radiation is different from the second dose.

For example the first and second doses of radiation may have a different power.

Preferably the radiation source extends substantially the whole printable width.

A method of printing an image on a substrate in a plurality of passes using an inkjet printer, the printer having a print carriage for supporting a plurality of printheads adjacent the method comprising:

reciprocating the substrate during printing relative to the print carriage in a print direction indexing the print carriage in a direction transverse to the print direction during printing of the image, wherein the indexing distance in the transverse direction is less than 10%, preferably less than 5% of the width of the printhead array in the indexing direction.

In some arrangements, the indexing distance may be more than 10% of the printhead array width, but the image will still be built up in layers rather than in print swathes.

A broad aspect of the invention provides a method of printing an image in a plurality of print passes using an inkjet printer, the method comprising printing the image in layers of print. Preferably the printer does not print the image in print swathes.

As indicated herein, features relating to gloss control in printing are applicable to a wide range of printer architectures and are not restricted to the types of printers described herein.

For example, features of gloss control described herein may be applied to flat bed printers, drum printers or printers arranged to print onto a web, for example in reel-to-reel printers.

According to a further aspect, there is provided a method of printing an image on a substrate using curable printing material using a printer comprising a radiation source, the method comprising: printing print material onto the substrate in a printing pass and emitting radiation from a first radiation source towards the print material to provide a first dose of radiation to the print material in a first curing step, and emitting radiation from a further radiation source towards the print material to provide a further dose of radiation to the print material in a further curing step, preferably wherein the first dose of radiation is between about 20% and 30% of the further dose of radiation.

Preferably the size of the dose of radiation is determined based on the dose received at the print material (for example the printed ink). In some cases, in particular where the speed of relative movement between the printheads and the substrate is the same for the first and further curing steps, it will be convenient to consider the relative doses of radiation to be equivalent to the dose of radiation emitted by the radiation source in the first and further curing steps.

Different ways of changing the dose of radiation effected by the source(s) are envisaged and include one or more of using a different number of sources, different power input to the sources, different configuration of the sources, turning off one or more elements of the sources.

The radiation source of the first curing step may be different from the radiation source of the further curing step.

The first and further radiation sources may be the same source, or one source may comprise a subset of the other source and or an altered version of the other source.

The printer may include a radiation source having a baffle or screen, wherein the first radiation source comprises the radiation source having the baffle or screen in a first configuration, and the further radiation source comprises the radiation source having the baffle or screen in a further configuration.

According to another aspect, there is provided a method of printing an image on a substrate using curable printing material using a printer comprising a radiation source comprising a baffle or screen, the method comprising: printing print material onto the substrate in a printing pass and emitting radiation from the radiation source having the baffle or screen in a first configuration, towards the print material, to provide a first dose of radiation to the print material in a first curing step, and emitting radiation from the radiation source having the baffle or screen in a further configuration towards the print material to provide a further dose of radiation to the print material in a further curing step.

Thus the use of screens or shutters can effectively change the dose of radiation received at the substrate for curing the ink.

Screens or shutters are thought to be particularly useful in the case where the first dose is to be less than 20% of the further dose. It is difficult to control the power input to the radiation sources to be less than 20% of power, as source (for example mercury lamp) has a tendency to turn off. Large differences in the speed of different curing steps can also be disadvantageous as it can lead to decrease in print quality (for example at high printing speeds) and/or decrease in printing efficiency.

In some cases, turning radiation sources on and off to obtain the required radiation dose is also not an attractive option because some sources take some considerable time to warm up from being off to being ready for use. The use of movable shutters provides a potentially simple but effective solution.

The speed of relative movement of the radiation source and the substrate during the first and further curing steps may be different.

In this way, different curing doses can be obtained for the two curing steps. In some cases the same radiation source, operating at the same power, could be used for both steps, the different dose being delivered by means of selecting an appropriate speed of relative movement of the radiation source and substrate.

Preferably the relative speed during the further curing step is lower.

According to a further aspect of the invention there is provided a method of printing an image on a substrate using curable printing material using a printer comprising a radiation source, the method comprising: printing print material onto the substrate in a printing pass, effecting relative movement at a first speed between the radiation source and the substrate to provide a first dose of radiation to the print material in a first curing step, and effecting relative movement at a further speed between a radiation source and the substrate to provide a further dose of radiation to the print material in a further curing step.

The radiation source used in the further curing step may be the same as that in the first curing step. It may be emitting the radiation at the same or different power. It may have the same or different configuration as that of the first curing step.

Preferably the further speed is lower than the first speed, for example 20% or 30% of the first speed.

Preferably the method includes carrying out further printing passes and curing steps.

The dose of curing radiation applied for each curing step may be the same or different.

Preferably a final curing step delivers a large dose of radiation to the ink to effect final cure.

The arrangement may be such that the radiation dose in the first curing step is less than 30%, preferably less than 20% of that of the further curing step.

Preferably a radiation source extends across the full width of the image being printed, and preferably across the full printable width of the substrate.

Preferably the image is built up in layers of printed ink.

Aspects of the invention also provide apparatus for carrying out any of these method aspects.

One or more of the radiation sources may comprise one or more elements, for example mercury lamps.

By controlling the gloss of the printed image, it has been found to be possible to control the colour saturation of the image.

The ability to produce glossy images can give opportunities for a wider colour gamut leading to control and obtaining of saturated colours. Saturation is a by-product of gloss: gloss coating generally has a more saturated colour appearance than matte.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

The invention extends to methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa.

Furthermore, features implemented in hardware may generally be implemented in software, and vice versa. Any reference to software and hardware features herein should be construed accordingly.

Preferred features of the present invention will now be described, purely by way of example, with reference to the accompanying drawings, in which.

Figure 8:
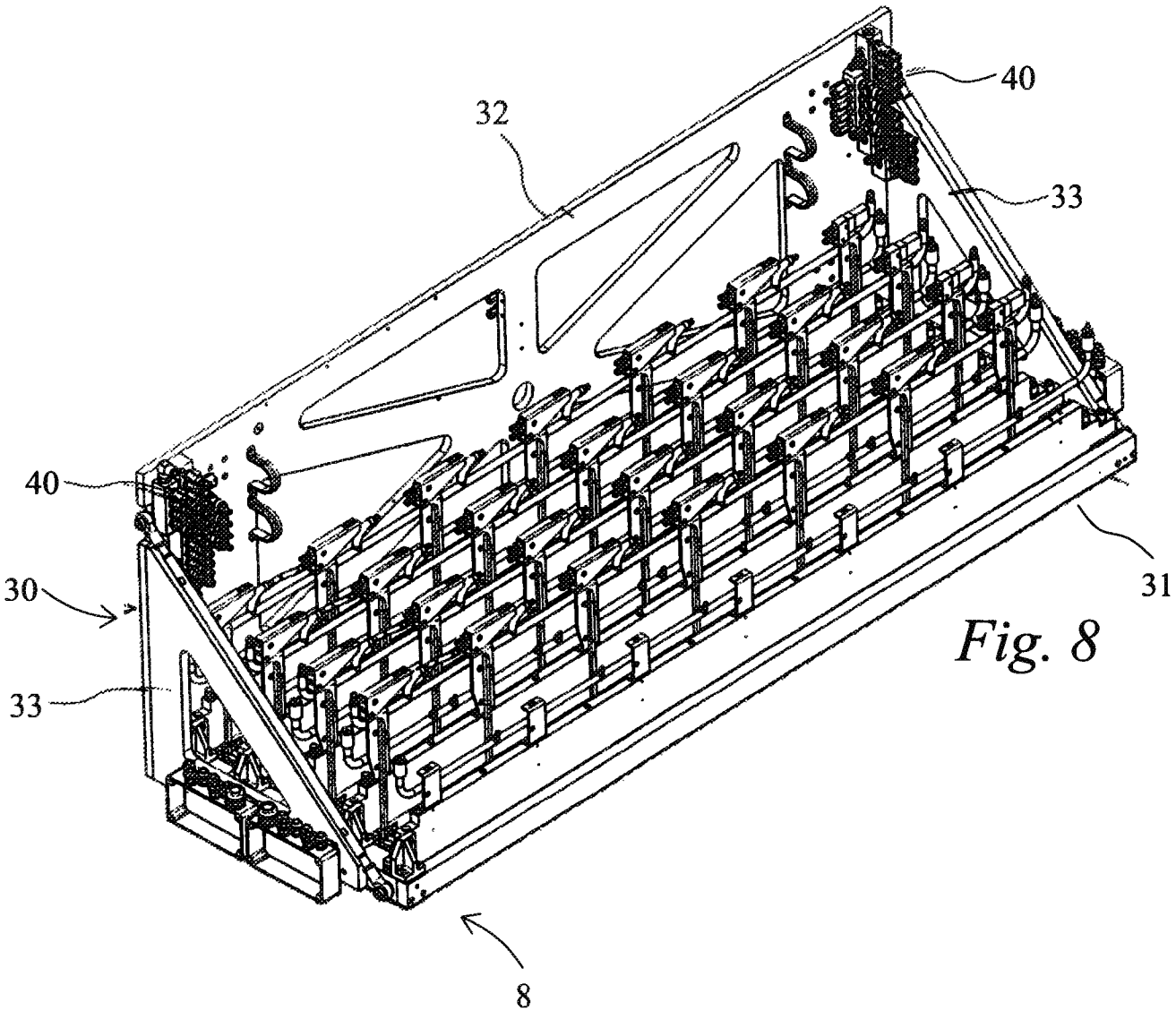
FIG. 8 shows a perspective view of a print carriage for supporting printhead modules of FIG. 6.

FIG. 10*a* shows a side view of a rib of the print carriage of FIG. 8;

FIG. 10*b* shows a plan view from above of the rib;

FIG. 10*c* shows a sectional view of the rib taken at A-A of FIG. 10*a;*

Figure 11:
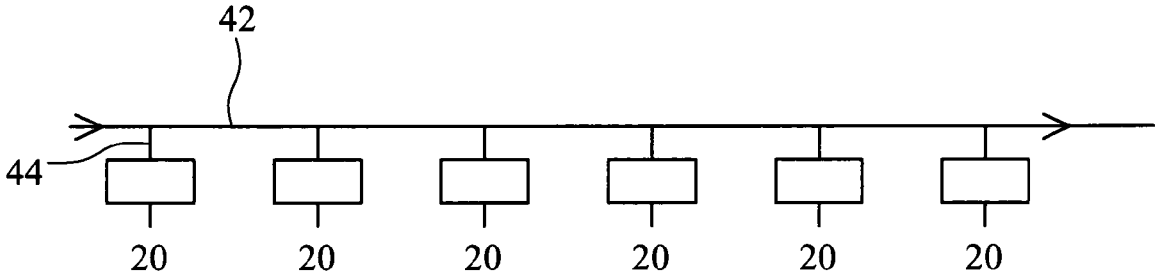
Figure 12:
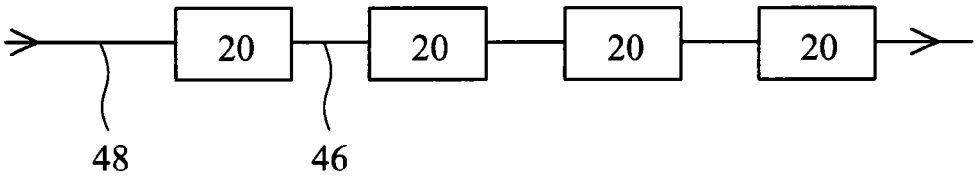
Figure 13:
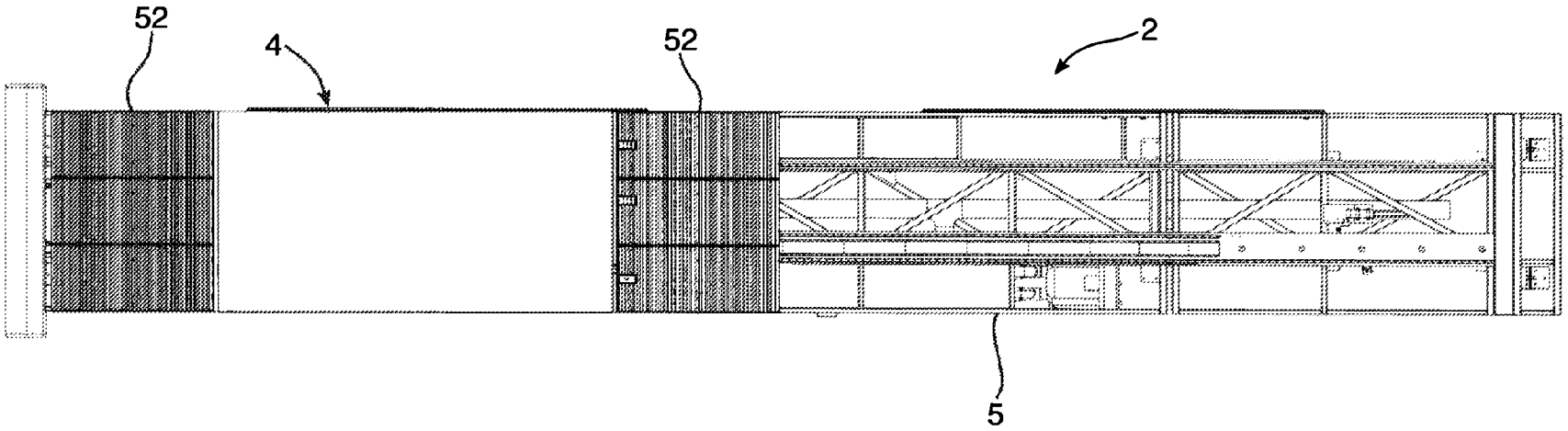
Figure 14:
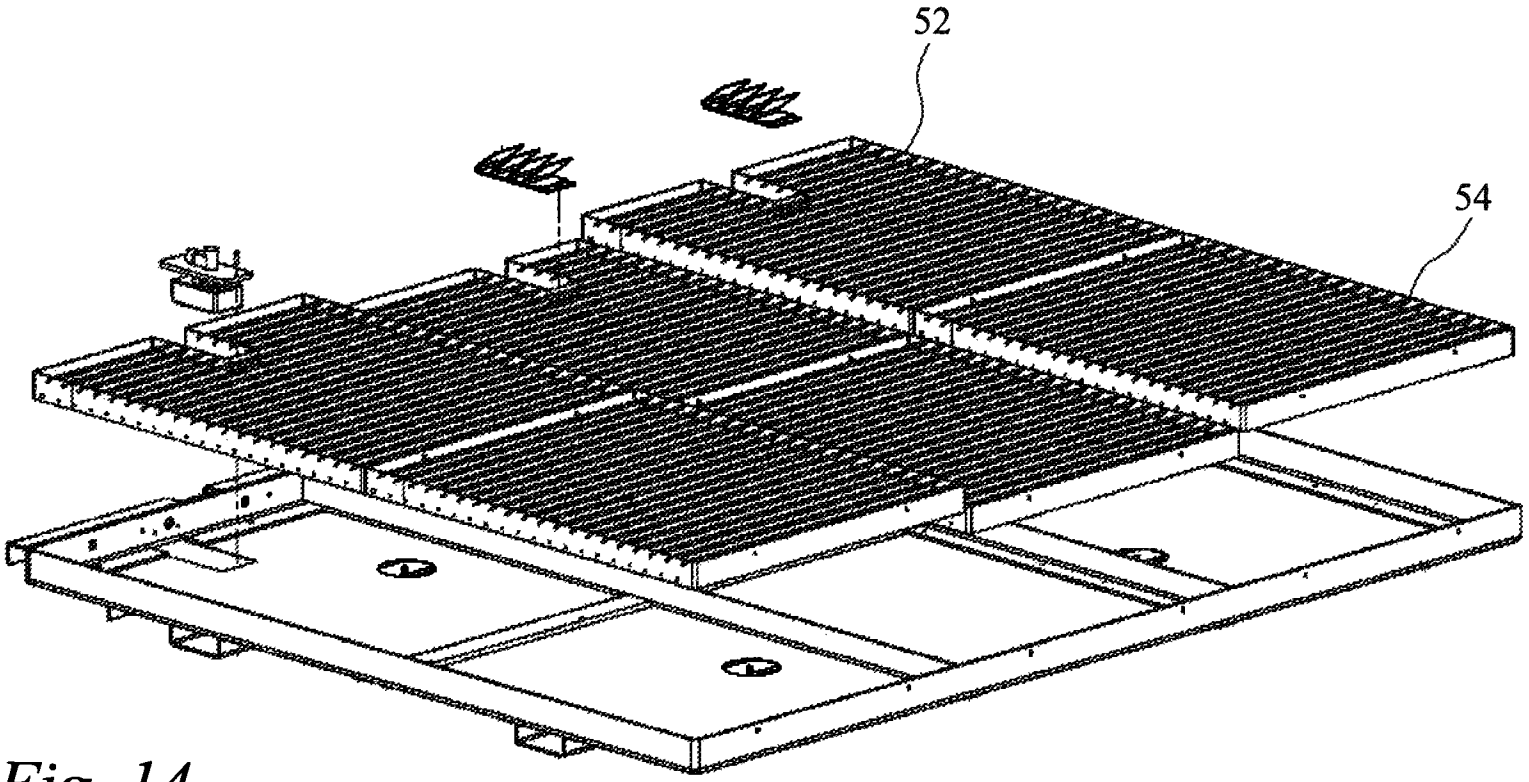
Figure 15:
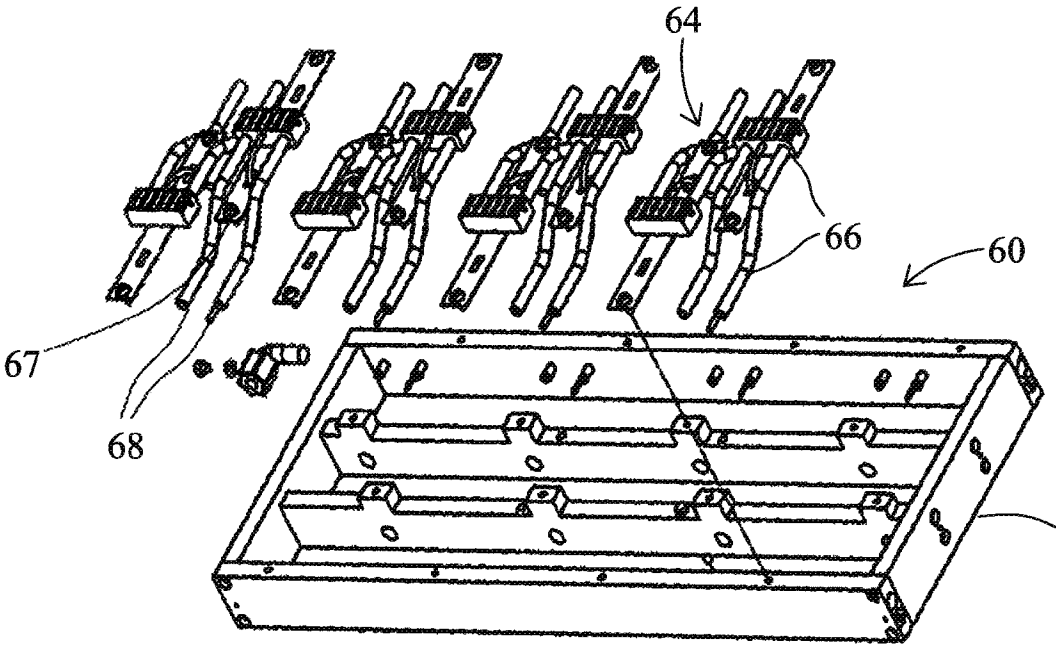
Figure 16:
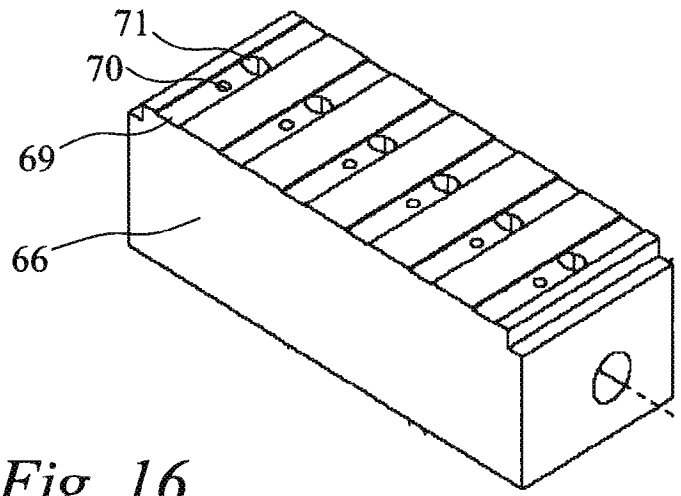
Figure 17:
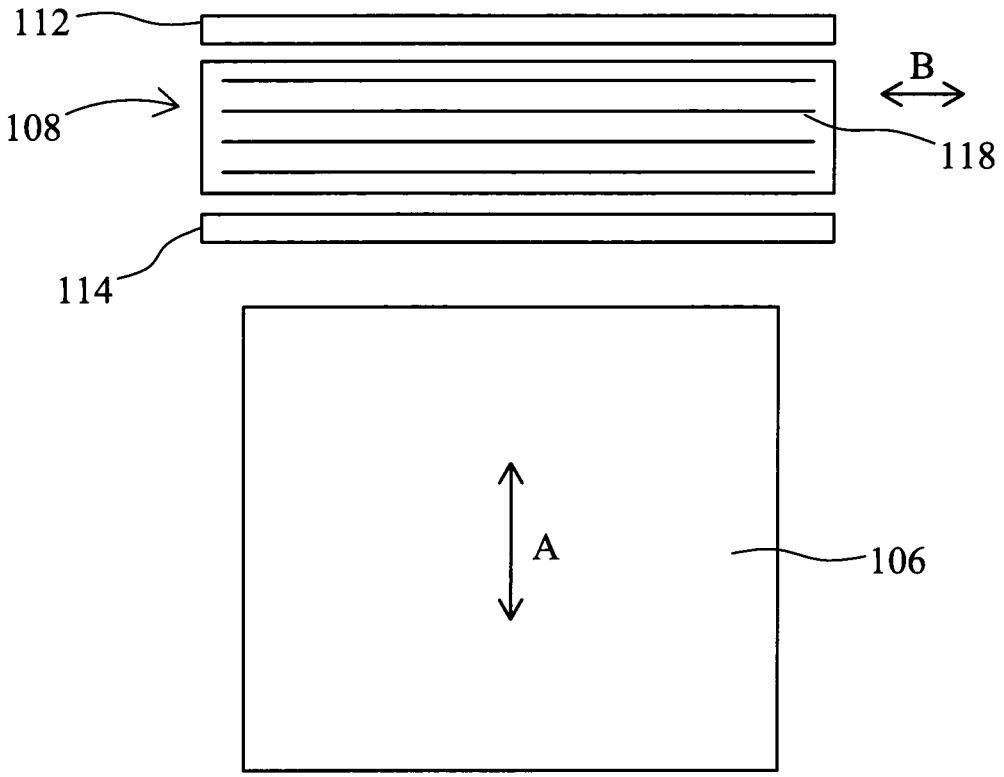
Figure 18:
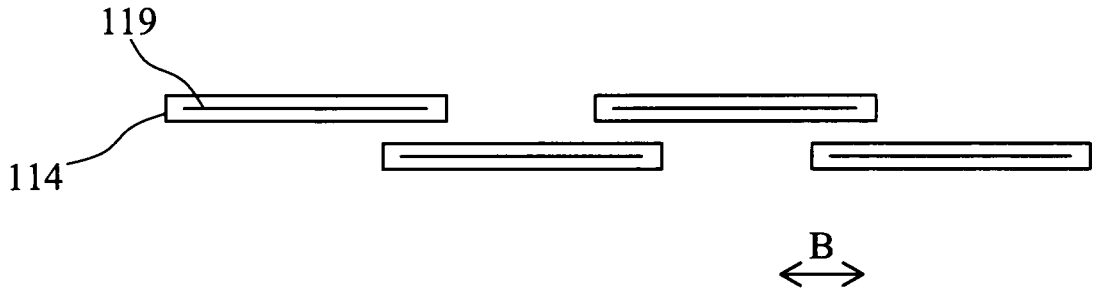
Figure 19:
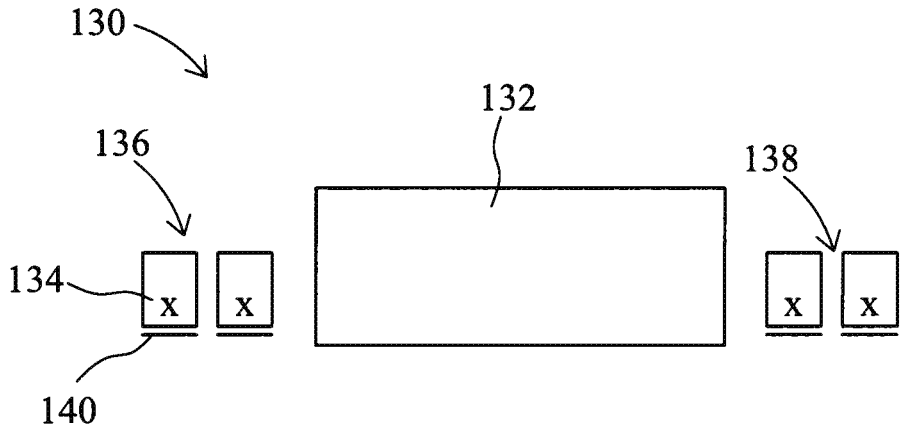

FIG. 11 shows schematically a common rail supplying ink to six printhead modules; and FIG. 12 shows schematically data connections for four printhead modules;

FIG. 13 is a plan view of the substrate table section;

FIG. 14 shows a partly exploded perspective view of a louvre section of the substrate table;

FIG. 15 shows a partly exploded perspective view of a cleaning module;

FIG. 16 shows a perspective view of a cleaning shoe of the cleaning module of FIG. 15;

FIG. 17 shows schematically a plan view of an alternative example of a printhead arrangement;

FIG. 18 shows schematically a plan view of a detail of a part of the printhead array of FIG. 17; and FIG. 19 shows schematically a side view of a further example of a print carriage arrangement.

Figure 1:
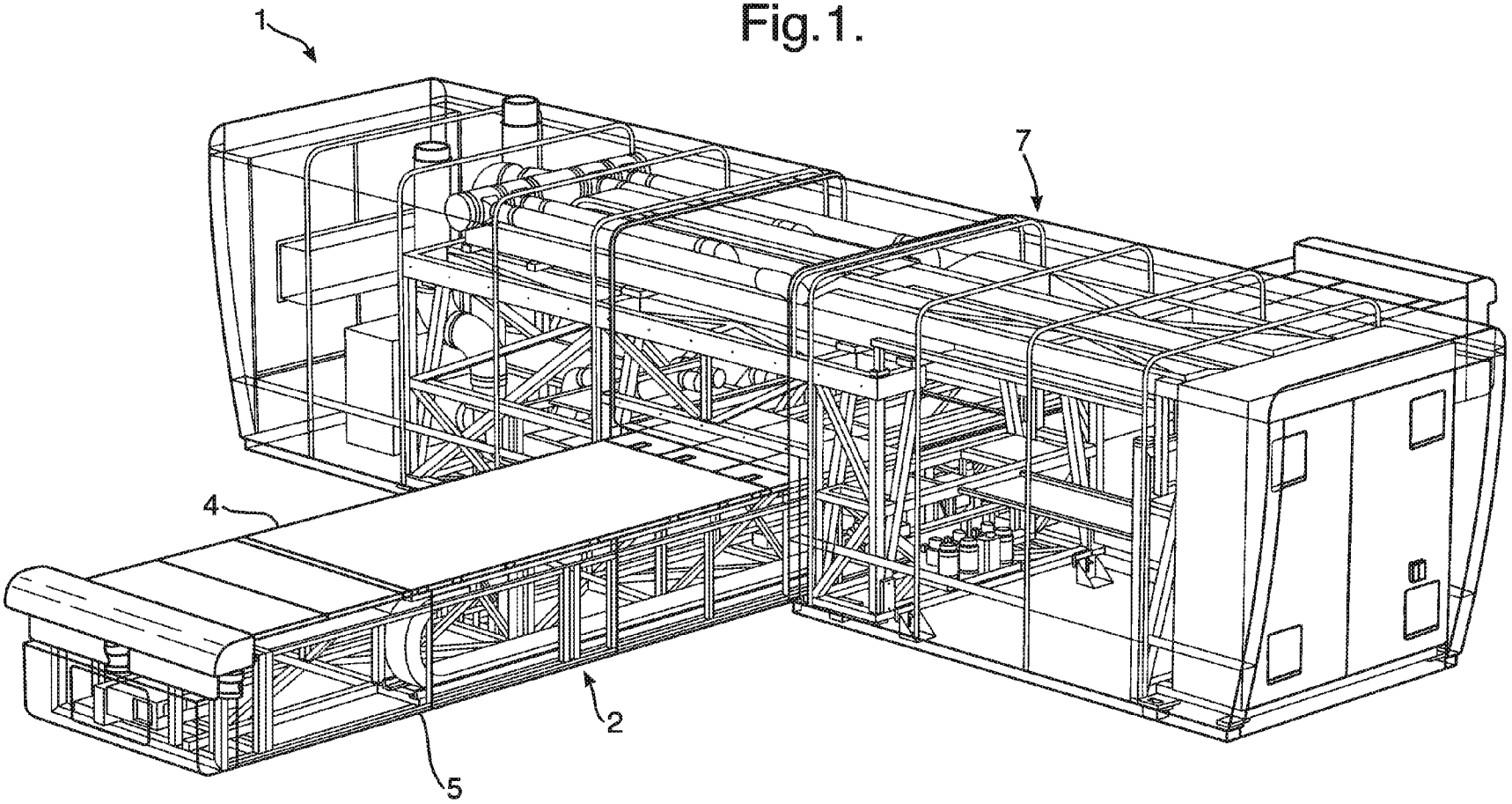
FIG. 1 shows a perspective view of a large-scale inkjet printer.

FIG. 1 shows an inkjet printer 1. The printer 1 generally comprises a substrate table section 2 and a gantry section 7. The substrate table section 2 includes a movable substrate table 4 for supporting a substrate 6 (not shown here) and a substrate table movement mechanism 5. The gantry section 7 is arranged to support a printhead carriage 8. In use a substrate 6 is mounted on the substrate table 4 for printing using printheads supported by print carriage 8.

The gantry section 7 and the substrate table section 2 both have a generally rectangular footprint. A recess is provided in a lower portion of the gantry section 7 approximately in the centre region, and the substrate table section 4 extends through the recess so that the gantry section 7 and the substrate table section 2 are arranged in the form of a cross where the gantry section 7 and the substrate table section 2 extend substantially perpendicularly to each other. The print carriage arrangement is provided in the gantry section 7 in the region where the gantry section 7 and the substrate table section 4 intersect. Thus as the substrate 6 is reciprocated on the substrate table 4 along the movement mechanism 5, the substrate 6 passes backwards and forwards in the recess in the gantry in the region of the print carriage arrangement and thus past the printheads.

Figure 2:
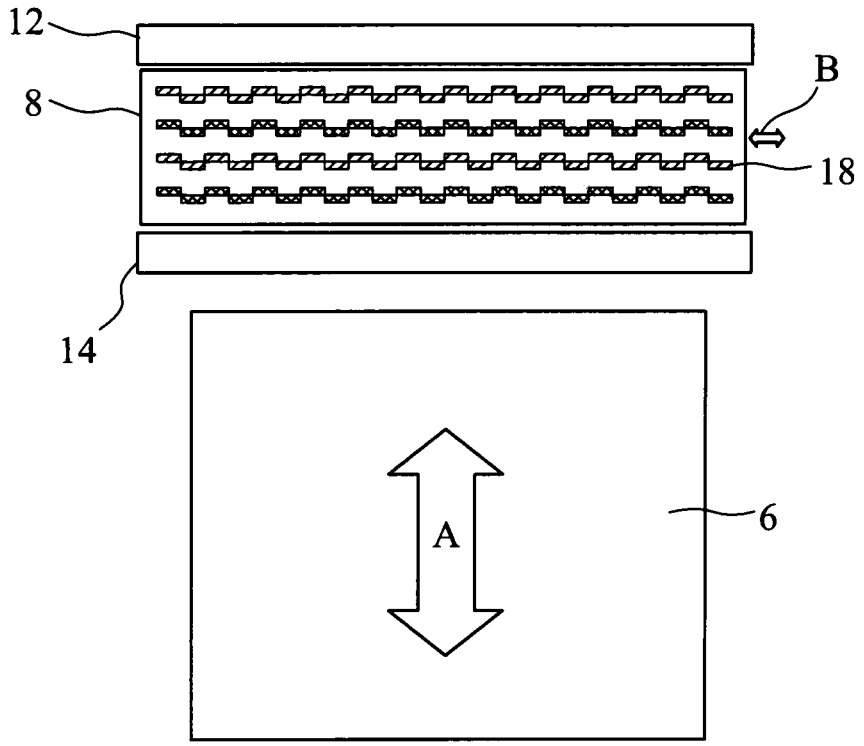
FIG. 2 shows a schematic plan view of components including the printhead arrangement of the inkjet printer of FIG. 1.

FIG. 2 shows a schematic plan view including the printhead arrangement. It will be seen that the substrate 6 (which is supported on the substrate table 4) reciprocates in the printing direction A under the print carriage 8 during printing by means of the movement mechanism 5 to form an image on the substrate 6 in multiple passes of the substrate under the print carriage 8.

Curing lamps 12 and 14 are provided on either side of the print carriage. The print carriage 8, and curing lamps 12, 14 are supported by gantry 7.

The print carriage 8 supports an array of printheads 18. It will be seen that the width of the print carriage 8 and also of the array of printheads 18 transverse to the print direction A is greater than the width of the substrate 6 to be printed. Thus the printheads 18 mounted in the print carriage 8 can be used to print a full width image onto the substrate 6 in each pass.

In the present example. a small amount of indexing in the transverse direction B occurs between passes. The print carriage 8 is thus movably mounted on the gantry 7. As discussed above, by indexing the printheads a small distance between passes, improvements in print quality can be obtained.

In an example, the width of the printhead array is 1.56 m and this printhead array is used to print an image 1.524 m wide. In an example of a printing mode in which this image can be printed onto the substrate, the image is printed in four passes of the substrate under the printhead array. The printheads are indexed transverse to the direction of travel of the substrate by about 12 mm for each pass. In this example therefore, the printhead array may start overlapping one side of the area of the substrate which is to be printed, and will end overlapping the other side of the area onto which the image has been printed.

In this example, UV curing ink is printed onto the substrate and it will be seen from FIG. 2 that the curing devices 12, 14 are provided. The curing devices are not attached to the print carriage 8 in this example. The curing devices 12, 14 may also index with the print carriage 8 in direction B, but preferably the curing devices 12. 14 are fixed relative to the gantry 7.

The print carriage 8 includes an array of printheads 18 for each of the four colours CMYK. In the arrangement shown, 144 printheads are used for each colour, giving 576 printheads for a CMYK four-colour print arrangement; such a large printhead arrangement allows for a print width of more than 1.5 m. In the printer shown in FIGS. 1 and 2, the width of the substrate table 4 is 1.6 m, its length is 3.25 m, and the height of the gantry is about 2 m.

Figure 3:
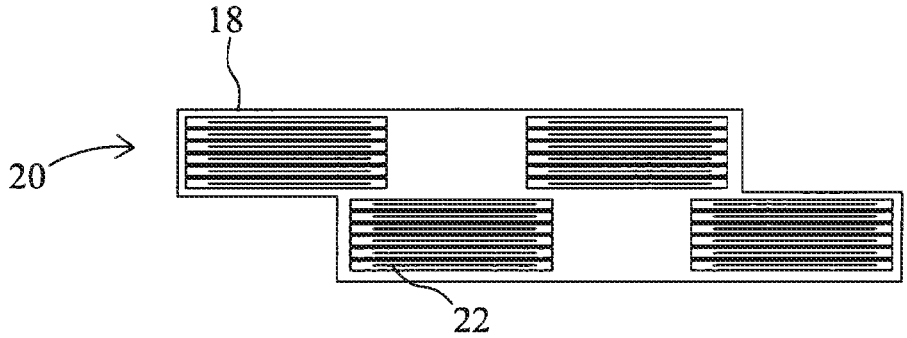
FIG. 3 shows schematically a printhead module of the printhead arrangement of FIG. 2.

As shown in FIG. 3, the printheads 18 are grouped into modules 20 each comprising 24 printheads. The printheads are arranged in four groups of 6 printheads. The printheads used here are Spectra SE printheads manufactured by Fujifilm Dimatix It will be seen that the width of the nozzle row 22 in each printhead is less than the width of the printhead 18 itself. The four groups of printheads are arranged in two offset rows of printheads to give a continuous array of nozzles in the transverse direction, in this case the direction of the nozzle rows 22.

Figure 4:
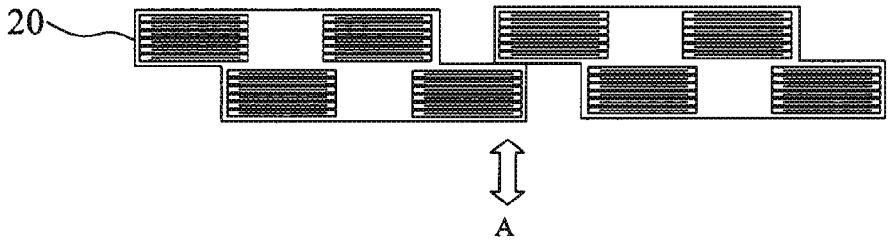
FIG. 4 shows schematically two printhead modules nested together.
Figure 5:
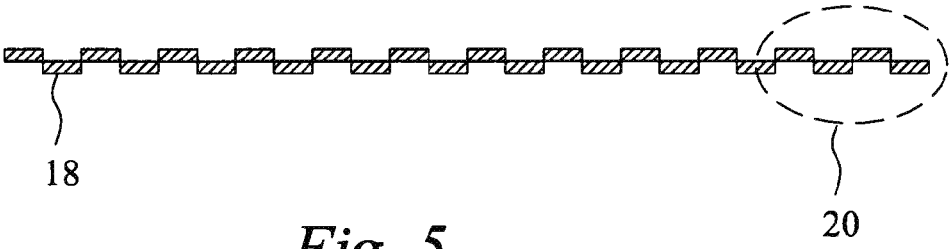
FIG. 5 shows schematically six printhead modules nested together.

The use of the modules 20 containing a large number of printheads 18 reduces the number of field replaceable components of the printer and can reduce the number of connections within the machine. These modules 20 are designed so that when placed next to each other there is a continuous array of print nozzles. This is done in this example by overlapping parts of a module in a nesting arrangement with an adjacent module as shown in FIG. 4. An array of six modules gives a full array of printheads as shown in FIG. 5.

Figure 6:
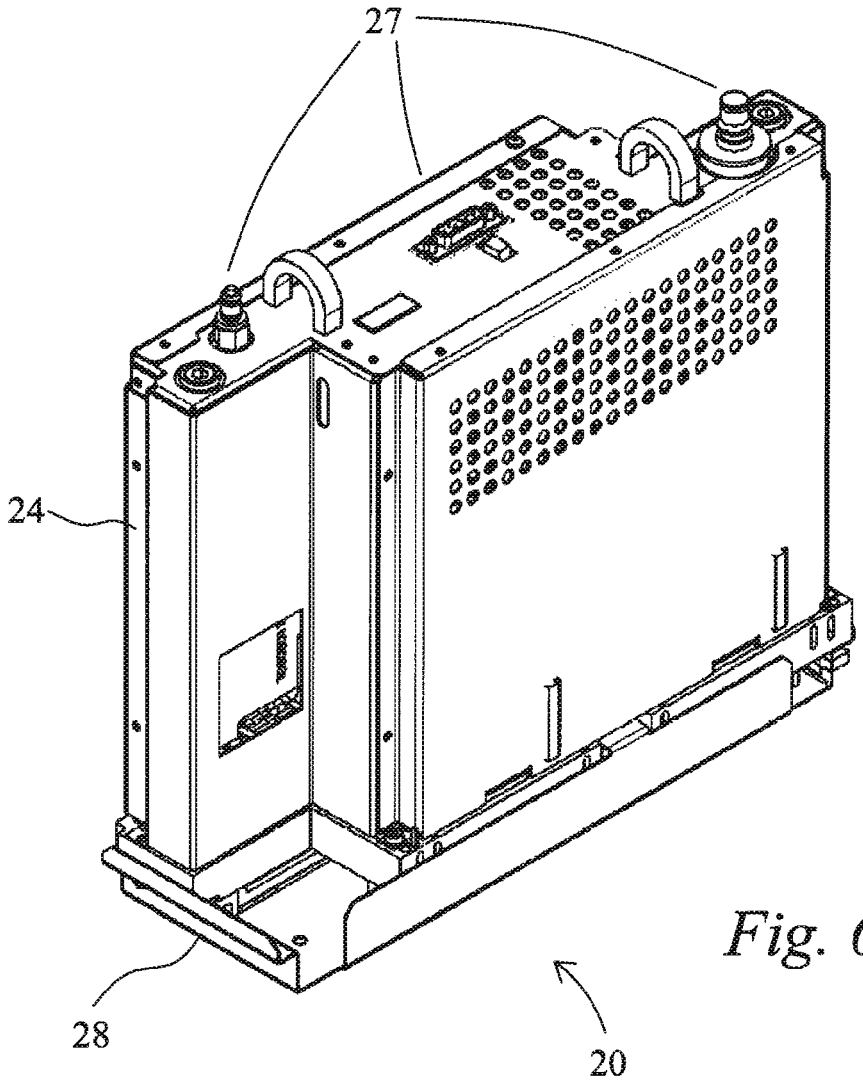
FIG. 6 shows a perspective view of a printhead module.
Figure 7:
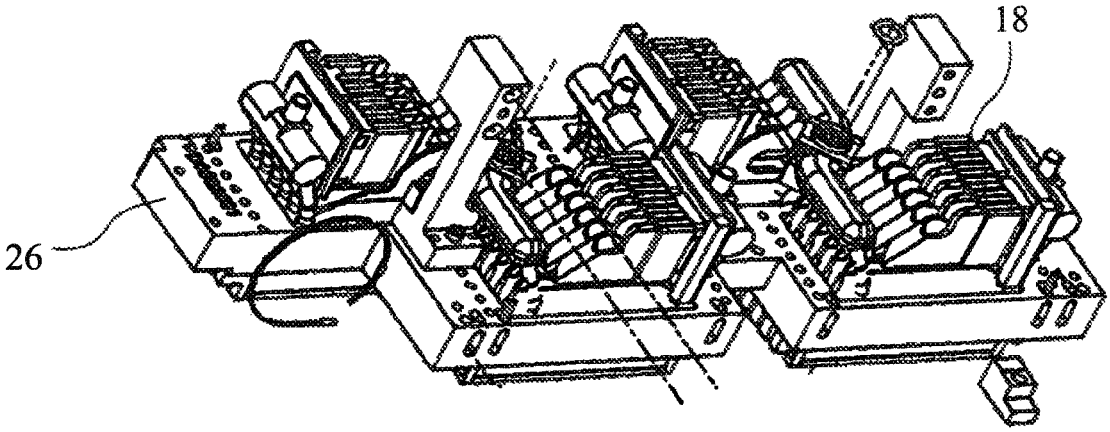
FIG. 7 shows a perspective view of a printhead arrangement for a printhead module of FIG. 6.

FIG. 6 shows a perspective view of a printhead module 20. It will be seen that the module comprises a housing 24 arranged to accommodate the offset rows of printhead groups as shown in FIG. 3. Contained within the housing 24 is the printhead support module 26 shown in FIG. 7. This support module 26 houses the printheads 18 and also provides inlets for the various services (for example ink supply) which are supplied to the printheads 18 during use. An upper surface of the module 20 includes various inlet and outlet ports 27 for the supply of the services to the printheads. Also enclosed in the housing 24 and in connection with the printheads are other components relating to the control of the printheads. For example, the housing 24 may include control electronics for controlling the printheads 18.

Also shown in FIG. 6 is a base plate 28 which may be clipped to the housing 24 to cover the printheads 18 to provide the printheads with protection during transit and installation.

Figure 9:
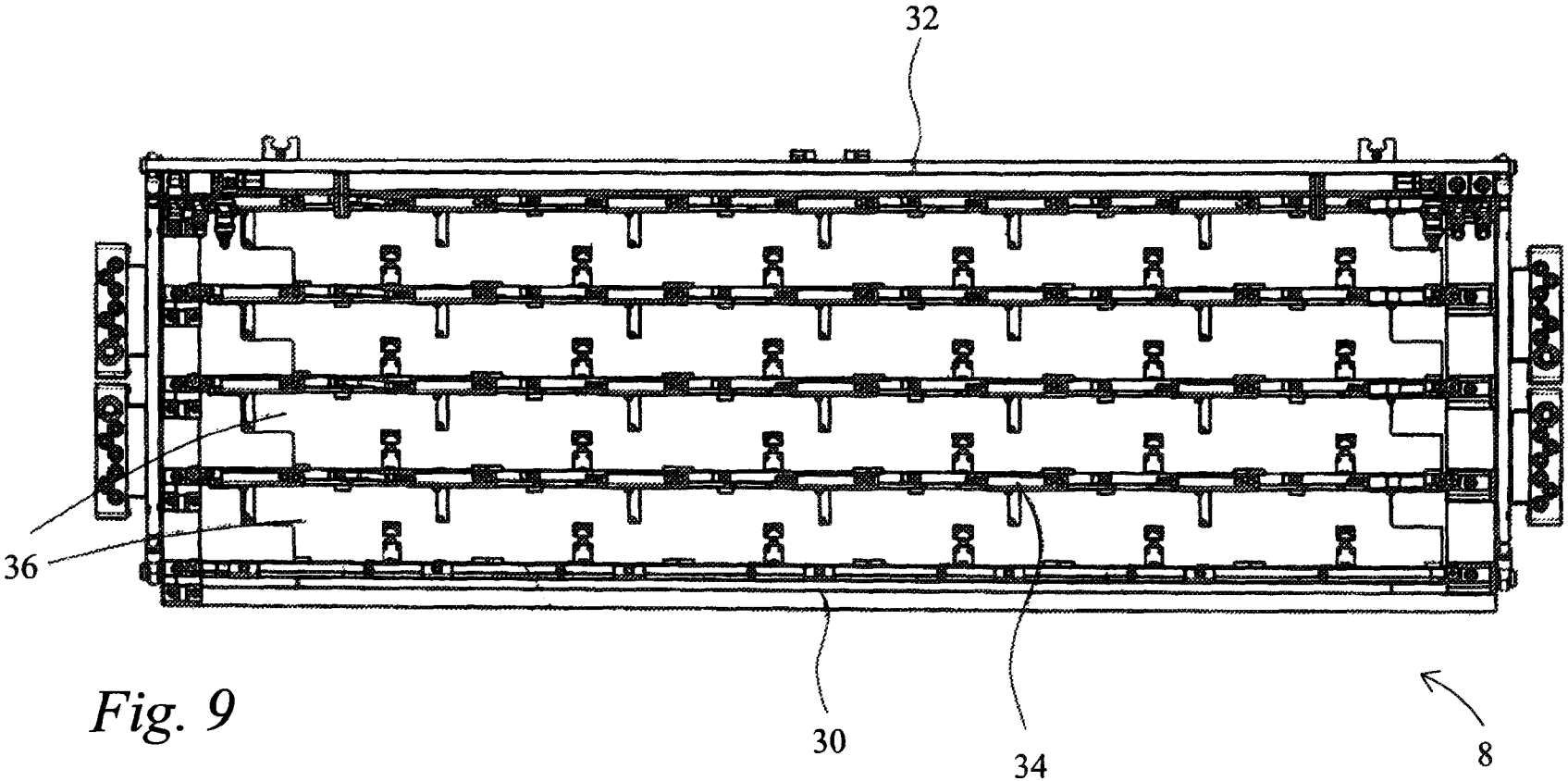
FIG. 9 shows a plan view of the print carriage of FIG. 8.

FIG. 8 shows a perspective view of a print carriage 8 for supporting printhead modules of FIG. 6, and FIG. 9 shows a plan view of the print carriage 8 of FIG. 8.

It will be seen that the print carriage 8 includes a generally rectangular base 31, and a back wall 32 extending substantially perpendicularly upwards from the base 31.

Generally triangular side walls 33 extend between the base 31 and the back wall 32 to provide support to the structure. Extending between the side wails 33 and substantially parallel to the back wall 32 are a plurality of fins 34. When installed in the print carriage 8, the fins 34 extend upwards from the base 31 to approximately half of the height of the back wall.

The fins 34 have two main functions in the print carriage 8. Firstly, they provide support to the printhead modules 20. It will be seen, in particular from FIG. 9, that the parallel fins 34 define four channels 36 into which the printhead modules 20 are mounted.

The second main function of the fins 34 is to provide common rails for supplying services to the printhead modules 20.

FIGS. 10 *a, b* and *c* show the rib 34 in more detail. As can be seen from FIGS. 10*a* and 10*c*, the rib provides several common rails for supplying services to the printhead modules 20. For example, the rib includes two external common rails 36, 37 and also internal common rails which are machined into the base section 38 of the rib 34.

Outlet spurs 39, 39' can be seen in FIG. 10*a*. Suitable connectors (not shown) are provided to link the common rails and other supply inlets and outlets to the printhead modules or other component as required.

It will be seen that the upper portion of the back wail 32 is provided with ports 40 which may be connected to the common rails or other components as required.

Examples of services which may be provided by the common rails include ink supply, vacuum, and water for cooling the printheads. FIG. 11 shows schematically the supply of ink to the printhead modules 20. Six modules 20 are shown in FIG. 11 being supplied ink from a common rail 42. The common rail may comprise a stainless steel tube with welded in junctions and having a diameter of about 8 mm, Spurs 44 extend between the common rail 42 and the module 20.

FIG. 12 shows data and control for a module 20 being supplied by fibre optic links: one for transmit 46 and one for receive 48. The fibres in this example are OM1 multimode 62.5/125 microns, running at 1.056 GBits/sec.

The available bandwidth determines the number of modules which may be linked together in series (daisy-chained). In this case, four modules 20 are linked together. In this way, a group of four modules can be controlled effectively from one transmit fibre and one receive fibre.

Since the print carriage arrangement is such that each module 20 is adjacent two fins 34, it is not always necessary for each and every service to be provided by each fin.

For example, vacuum supply may be provided only on alternate fins 34.

Alignment between printheads is important with regard to print quality. Alignments within a module are set at the factory when the module is assembled and thus only alignments between modules 20 need to be set on installation in the machine. This requires 2 axes of adjustment for each of the 24 modules. This may be done using small actuators to move the modules and a camera mounted on the substrate table of the machine to measure nozzle positions. When correctly positioned the modules can be locked in place and the position then verified with the same camera. Alternatively the module alignments could be inferred from print patterns using a scanner attached to the carriage. In this example, two motors 50 for making the alignment adjustments are provided on the fins 34. The two motors provide the two axes of movement (rotation and nozzle direction translation) of the module 20 relative to the carriage.

During printing, printhead modules are locked into position. During alignment the locking screws are removed or loosened so that movement of the modules is enabled.

The axes of the modules are then made live so that the modules may move in the two axes of movement. The position of the nozzles is determined using the camera and an operator remotely makes any necessary changes by actuating the relevant motors.

The modules can therefore be aligned with each other and with the printhead carriage.

When the position of the modules has been changed as necessary, the locking screws are reengaged so as to lock the modules into position.

The curing lamps 12, 14 comprise mercury arc lamps manufactured by GEW Ltd. For multipass printing, the lamps are controlled so as to change the power of the lamps between passes. For example, the power of the lamps on initial passes may be 30 W/cm, with a higher power of 140 W/cm being used for a subsequent pass, for example the last pass to fully cure the ink. A suitable control unit is included to control the power of the lamps.

The curing lamps 12 and 14 are fitted with rotary shutters to reduce stray light when the lamps are in standby. To reduce further the amount of light reflected onto the printheads, the substrate table 4 also includes louvre sections 52 at each end of the table 4 as can be seen in more detail in FIG. 13. FIG. 14 shows a partly exploded perspective view of a louvre section of the substrate table. The louvre sections 52 are substantially coplanar with the upper surface of the table 4. In this arrangement, the louvers 52 comprise a plurality of substantially parallel angled bars 54 which are fixed to reflect radiation in a direction generally away from the printheads. The bars 54 are painted black to reduce reflection. In this arrangement, for ease of manufacture, the louvres are provided as three elements which are mounted into a base attached to the substrate table. In this way, different louvre arrangements can be provided by replacing the elements.

The carriage 8 containing the printheads 18 can in preferred arrangements be moved sideways within the housing to be fully clear of the substrate table section 2, to give good access for maintenance of the modules 20 from above and from below. This helps reduce down time from any malfunctions. It will be appreciated that in the printer described herein, the carriage will not normally extend outside the outer housing of the printer, even during maintenance. The housing of the printer is in fact so large that maintenance personnel can enter within the housing to carry out repairs and maintenance. Preferably the housing includes an access door. For safety, it is preferred that the printer includes a safety interlock so that the printer may not be operated when there is personnel within the housing or the access door is open.

Preferred cleaning shoes for cleaning the printheads are designed to clean many heads at once to reduce the overall time for cleaning the whole array. FIGS. 15 and 16 show features of a cleaning module 60. Cleaning module 60 includes a generally rectangular housing 62 and four cleaning shoe arrangements 64 which are, in use, mounted in the housing 62. Each cleaning shoe arrangement 64 includes two cleaning shoes 66 and inlet and outlet ducts 67, 68 for each shoe 66.

The cleaning module is mounted adjacent the print carriage during printing. When the print carriage 8 is moved out to the side of the substrate table, the printheads move in engagement with the cleaning shoes 66 thereby cleaning all of the printheads. Vertical movement by the cleaning module and/or the print carriage may be effected for improved contact between the shoe 66 and the printhead 18.

The shoes 66 will be arranged in the cleaning module 60 and the cleaning module 60 arranged in the printer having regard to the arrangement of printheads to be cleaned.

In the present example, the arrangement is such that the whole of depth of the printheads can be cleaned at the same time and thus the whole array of printheads may be cleaned in a single reciprocation of the print carriage over the cleaning module.

FIG. 16 shows a cleaning shoe in more detail. The shoe 66 is the general form of a block having 6 generally parallel channels 69 in one surface. In each channel, there is an outlet 71 and an inlet 70 orifice and the block includes channels connected to the ducts 67 and 68.

In use a vacuum is applied to the outlet orifice 71. As the print carriage is passed over the cleaning module 60, debris and excess ink is cleaned from the printheads. The application of the vacuum can also assist in priming the nozzles of the printheads 18.

A cleaning fluid may be emitted from the inlet orifice 70 further to clean the printheads.

Ink jet printers are normally shipped as a single unit for convenience and quick commissioning at the final customer site. For the large machine described here it would be difficult to ship in one piece, so the substrate table section 2 including the substrate table 4 and its mechanism 5 are a separate structure from the gantry 7 including the print carriage 8. The substrate table section 2 and gantry section 7 may therefore be shipped separately, for example by lorry without a special convoy (which would normally be required for very large loads), or packed into standard shipping containers.

Suitable fixing members are provided for securely attaching the substrate table section 2 to the gantry section 7 on site. Preferably the fixing members are such that the substrate table section 2 may subsequently be dismantled from the gantry section 7.

This allows the machine to assembled, for example for testing during manufacture, and then subsequently be dismantled for shipping to a customer. Further, the printer can be dismantled after installation for example if it is required to be moved.

FIG. 17 shows an alternative example of a printhead and UV source arrangement.

The arrangement of FIG. 17 may be provided in a printer for example such as that described above, for example having reference to FIG. 1. In the arrangement of FIG. 17, a substrate 106 comprising a rigid board comprising PVC and having a thickness of 0.5 mm is arranged to reciprocate in the print direction A relative to a print carriage 108. Curing lamps 112 and 114 are provided on either side of the print carriage 108. The print carriage 108, curing lamps 112 and 114 are supported by the gantry 7 of FIG. 1.

The print carriage 108 supports an array of printheads 118. The arrangement is similar to that of FIG. 2, except here the printhead array includes only a single array of printheads 118 for each of the four colours CMYK.

As is shown in more detail in FIG. 18, the printheads 118 are arranged in a single depth per colour in a generally linear array. The array is slightly staggered to allow for there to be some overlap of the ends of adjacent printheads 118 so that a line of nozzles 119 of one printhead is continuous in the indexing direction (perpendicular to the print direction here) with the line of nozzles 119 of an adjacent printhead 118. In this way, a continuous array of nozzles perpendicular to the print direction A can be achieved.

In this arrangement the printheads need not be arranged in modules as described above. In arrangements such as that described above for FIG. 2, the printhead array might include 72000 nozzles. In an arrangement such as that shown in FIG. 17, the printhead array might include for example 12000 nozzles.

While the use of fewer printheads can have an effect on print quality, by using fewer printheads, the print carriage 108 and the footprint of the printer can be relatively small. With fewer printheads being required, the initial set up cost for the printer can be relatively low. Fewer curing lamps might be required in some arrangements.

Methods of operation of the printer to control gloss are now described. It should be understood that the methods described, while applicable to the printers described herein will also be generally applicable in respect of other printer arrangements.

In an example printer which may be similar to that described above, the print carriage arrangement 130 shown in FIG. 19 includes four UV lamps 134 arranged in two pairs 136, 138 either side of the print carriage 132. Each lamp 134 extends the full width of the printhead arrangement 132. Each lamp is mercury arc lamp having a maximum power of 22 kW. The lamps are air cooled in a known way and have a shutter 140 to reduce light leakage from the lamp when the lamp is held in "standby" mode. The standby power level is about 20% of full power. Beneath the shutter may be a quartz window, for sealing the lamp to reduce the risk of the lamp ingesting ink mist, and to reduce the risk of the air cooling mechanism for the lamp interfering with the jets of ink from the printheads.

Where a "satin" or low gloss finish to the printed substrate is required, the lamps are operated at a constant high power throughout the printing: typically 100% power on two lamps. In this case, the aim is to substantially fully cure each pass of ink so that subsequent passes of ink are printed onto cured ink. Such ink has a relatively low surface energy and so subsequent droplets of ink form relatively tall structures on the ink surface, giving a matte or satin appearance.

For a gloss finish to the printed substrate, the lamps are held at a lower power, for example 20% power, during the printing of the image. After the image has been printed, the lamps are then switched to full power (100%) for a final curing pass. This extra curing pass can have the effect that gloss modes are slower than the equivalent satin mode.

The switching of the lamps from lower (for example 20%) power to full power may be effected by changing the power input to the lamp, or might be conveniently done by moving the shutters 140 or providing other shutters or baffles to control the amount of light reaching the printed substrate. Thus where reference is made to the lamps being at a lower power, the effective power of the lamps might be reduced by the use of baffles or shutters, thus reducing the percentage of the radiation emitted by the lamps which reaches the printed substrate.

In the example described, alternatively or in addition to changing the effective power output of the lamps, one or more of the print passes may be carried out at different speeds. It will be understood that where the print speed is reduced, then the curing dose received by the printed substrate will be increased. Equally, by increasing the printing speed, the effective dose of curing radiation can be reduced.

Intermediate levels of gloss can be achieved by increasing the radiation source power level, for example to 30%. Different effective power levels could be used for different print passes, for example to achieve other effects.

Without wishing to be bound by any particular theory, it is believed that the reason for the gloss being increased where the amount of curing radiation received by the printed substrate, is that the lower cure energy means that the surface of the ink on the substrate remains non-solidified after a pass. This allows more spreading of the ink droplet and hence a final flatter surface, and hence more gloss of the final image.

Satin or gloss modes may be printed unidirectionally or bidirectionaliy, although as the number of passes increase, the gloss levels have been found to reduce, because the ink laid down in the early passes becomes more fully cured before the final curing pass.

In some examples, the image is printed in 4 or 5 passes.

In an alternative arrangement, different numbers of lamps or other radiation sources are activated for the initial passes compared with the final cure pass.

As indicated above, features of the gloss control system and method are generally applicable to a wide variety of printers. Features of the method are particularly suitable where a continuous array of printhead nozzles is provided, as described above, so that the printed image can be built up in layers. In such a case, the curing of the print medium can be controlled layer by layer to give the desired gloss characteristics.

Features of the gloss control system and method also have application where the image is build up by a different method, for example in "lawn stripes". The printers described herein include flatbed inkjet printers, but features of the gloss control system are also applicable to other printers, for example drum printers and/or reel to reel printers.

The percentage of the effective dose of the radiation (for example the dose or curing energy per unit area received at the substrate) in a first curing step compared with a further curing step may be, for example, determined by consideration of the relative power outputs of the radiation sources used for the first and further curing steps, preferably taking into account the effect of any baffles or screens and the like, and the relative speed of movement of the source and substrate.

It will be understood that the present invention has been described above purely by way of example, and modification of detail can be made within the scope of the invention, Each feature disclosed in the description, and (where appropriate) the claims and drawings may be provided independently or in any appropriate combination.

The invention claimed is:

1. A multipass large format flat bed inkjet printer for printing an image on a substrate, the printer having:

a printhead carriage for supporting an array of printheads adjacent the substrate during printing;

a bed for supporting the substrate during printing;

a movement mechanism for providing relative movement of the printhead carriage and the substrate in a print direction during a print pass;

wherein the printhead carriage is such that the width of the array of printheads transverse to the print direction is at least substantially the full printable width of the substrate and wherein the printhead carriage is indexed in a direction transverse to the print direction between print passes, wherein the printhead carriage is indexed a distance less than 10% of the width of the printhead array, and wherein the printer comprises a curing device for curing print material printed onto the substrate wherein the curing device is connected to a fixed beam separate from the printhead carriage and extends across at least substantially the full printable width of the substrate transverse to the printing direction, the curing device being substantially fixed in the transverse direction and being substantially fixed during printing, and comprising a radiation source, the printer being adapted to print an image in a plurality of printing passes, each printing pass comprising the steps of printing print material onto the substrate and emitting radiation towards print material on the substrate from the curing device, wherein the printer includes a control device operable such that a first dose of radiation is emitted towards the print material on a first printing pass and a second different dose of radiation is emitted towards the print material on a subsequent curing pass.

2. A printer as claimed in claim 1, in which the printheads each include an array of nozzles, wherein the array of printheads is such that the array of nozzles is substantially continuous across the array of printheads.

3. A printer according to claim 1 wherein the control device controls one or more of the power input to the radiation device, the relative speed of movement of the radiation source and the substrate and the configuration of the radiation source.

4. A printer according to claim 1 wherein the printhead carriage is such that the printhead array is wider than the image width.

5. A printer according to claim 1 wherein substantially the full image width is printed in each print pass.

6. A printer according to claim 1 wherein the width of the substrate bed transverse to the print direction is not less than 1.5 m.

7. A printer according to claim 1 wherein the substrate bed comprises a movable table.

8. A printer according to claim 1 wherein the printer is adapted such that the printhead carriage is indexed a distance in the transverse direction less than 10% of the width of the printhead array in the transverse direction.

9. A printer according to claim 1 wherein the printhead carriage is adapted to hold the printheads in an interleaved array.

10. A printer according to claim 1 wherein the printhead carriage includes means for mounting a plurality of printhead modules each including a plurality of printheads.

11. A printer according to claim 1 wherein the printer includes a common rail for supplying a service to a plurality of printheads.

12. A printer according to claim 1, wherein the printhead carriage is translatable in a transverse direction, so as to be moved fully away from the substrate bed.

13. A printer according to claim 1 further comprising a gantry for supporting the printhead carriage, wherein the gantry is releasably attached to the substrate bed.

14. A printer according to claim 1 comprising a first module and second module, the first module comprising the substrate bed and associated control and movement devices and the second module comprising the printhead carriage and a gantry for supporting the printhead carriage and the radiation source wherein the first and second modules are releasably attachable to each other.

15. A printer according to claim 1, wherein the arrangement is such that a substantial proportion of the printed material deposited on the substrate remains on the substrate.

* * * * *

UNITED STATES PATENT AND TRADEMARK OFFICE

CERTIFICATE OF CORRECTION

PATENT NO. : 9,193,183 B2
APPLICATION NO. : 14/511665
DATED : November 24, 2015
INVENTOR(S) : Adam Woolfe et al.

It is certified that error appears in the above-identified patent and that said Letters Patent is hereby corrected as shown below:

On the Title Page, insert Item --(30) Foreign Application Priority Data: Apr. 23, 2007 (GB).....0707827.2--

Signed and Sealed this
Twenty-ninth Day of March, 2016

Michelle K. Lee

Michelle K. Lee
*Director of the United States Patent and Trademark Office*